US011092164B2

(12) United States Patent
Nelson et al.

(10) Patent No.: US 11,092,164 B2
(45) Date of Patent: Aug. 17, 2021

(54) NON-WELDED SUCTION CHAMBER FOR SURFACE PUMPING SYSTEMS

(71) Applicant: GE Oil & Gas ESP, Inc., Oklahoma City, OK (US)

(72) Inventors: Andrew Nelson, Oklahoma City, OK (US); Michael Card, Oklahoma City, OK (US); Craig Vickery, Oklahoma City, OK (US); Derek Justice, Oklahoma City, OK (US); Jonathan Ou, Oklahoma City, OK (US); William Haffey, Oklahoma City, OK (US)

(73) Assignee: Baker Hughes ESP, Inc., Houston, TX (US)

( * ) Notice: Subject to any disclaimer, the term of this patent is extended or adjusted under 35 U.S.C. 154(b) by 499 days.

(21) Appl. No.: 14/983,198

(22) Filed: Dec. 29, 2015

(65) Prior Publication Data

US 2017/0184123 A1 Jun. 29, 2017

(51) Int. Cl.

| | |
|---|---|
| ***F04D 29/42*** | (2006.01) |
| ***F04B 47/02*** | (2006.01) |
| ***F04D 29/12*** | (2006.01) |
| ***F04D 29/62*** | (2006.01) |
| ***F04D 1/06*** | (2006.01) |
| ***F04D 29/08*** | (2006.01) |

(Continued)

(52) U.S. Cl.

CPC ..... *F04D 29/4293* (2013.01); *F04B 47/02* (2013.01); *F04B 53/14* (2013.01); *F04B 53/146* (2013.01); *F04D 13/02* (2013.01); *F04D 29/126* (2013.01); *F04D 29/628* (2013.01); *F04D 1/063* (2013.01); *F04D 29/086* (2013.01); *F04D 29/4273* (2013.01)

(58) Field of Classification Search

None

See application file for complete search history.

(56) References Cited

U.S. PATENT DOCUMENTS

| | | | | |
|---|---|---|---|---|
| 1,475,676 A * | 11/1923 | Lewis | F04D 29/628 415/127 |
| 2,506,830 A * | 5/1950 | Hannay | F16L 27/087 285/278 |
| 2,945,709 A | 7/1960 | Freed et al. | |

(Continued)

FOREIGN PATENT DOCUMENTS

| | | |
|---|---|---|
| CN | 203394775 U | 8/2013 |
| CN | 104005995 A | 10/2013 |
| GB | 2 431 204 A | 4/2007 |

OTHER PUBLICATIONS

International Search Report and Written Opinion issued in connection with corresponding PCT Application No. PCT/US2016/068811 dated Apr. 20, 2017.

*Primary Examiner* — Peter J Bertheaud
*Assistant Examiner* — Geoffrey S Lee
(74) *Attorney, Agent, or Firm* — Crowe & Dunlevy, P.C.

(57) ABSTRACT

A suction chamber for use in a surface pumping system includes a central housing that is substantially cylindrical and has a motor end and a pump end opposite the motor end. The suction chamber includes a motor-end plate bolted to motor end of the central housing and a pump-end plate bolted to the pump end of the central housing. The suction chamber also includes an inlet branch connected to the central housing. A method for assembling a non-welded suction chamber is also disclosed.

18 Claims, 4 Drawing Sheets

(51) Int. Cl.
*F04B 53/14* (2006.01)
*F04D 13/02* (2006.01)

(56) References Cited

U.S. PATENT DOCUMENTS 3,059,582 A * 10/1962 Greene ..... F04D 29/426 285/367
3,367,276 A * 2/1968 Hatsuta ..... F04B 53/14 92/165 R
3,678,559 A 7/1972 Zilkalns
3,778,181 A * 12/1973 McFarlin ..... F04D 9/02 415/56.1
4,073,596 A * 2/1978 Erickson ..... F04D 1/12 415/112
4,211,519 A 7/1980 Hogan
4,345,785 A * 8/1982 Bradford ..... F16L 25/021 285/288.5
4,478,435 A * 10/1984 Cheshier ..... F16L 27/0808 285/147.1
4,822,080 A * 4/1989 Darish ..... F16L 27/0808 285/179
4,836,756 A * 6/1989 Fukumoto ..... F04B 43/0063 417/394
4,993,260 A * 2/1991 Bednarz ..... E03B 7/072 285/32
5,127,807 A * 7/1992 Eslinger ..... F04B 11/0008 403/371
5,344,291 A 9/1994 Antkowiak
5,366,331 A * 11/1994 Erbes ..... F16B 1/0014 411/361
5,445,494 A * 8/1995 Hanson ..... F04D 1/06 415/107
5,484,244 A * 1/1996 Glovan ..... F16B 1/0014 29/447
5,638,574 A * 6/1997 Haupt ..... A01G 20/47 15/330
5,681,459 A * 10/1997 Bowman ..... B01D 61/08 137/216
5,779,434 A 7/1998 De Long
5,898,113 A * 4/1999 Vecere ..... B01L 3/505 383/113
6,019,348 A * 2/2000 Powell ..... B60K 15/04 141/198
6,270,316 B1 8/2001 Precetti
6,461,115 B1 * 10/2002 Ferrier ..... F04C 27/009 417/360
6,712,403 B1 * 3/2004 Dusevic ..... F16L 23/032 285/363
6,926,492 B2 * 8/2005 Hegebarth ..... F04C 2/086 415/111
7,074,017 B2 7/2006 Coray et al.
7,104,766 B2 9/2006 Mascola
7,204,523 B2 * 4/2007 Wang ..... A47L 9/242 15/330
7,520,720 B2 * 4/2009 Welch ..... F04D 1/063 415/199.1
7,559,753 B2 7/2009 Burrage
8,016,571 B2 9/2011 Speer et al.
8,246,251 B1 * 8/2012 Gardner ..... F04D 13/086 384/420
8,480,384 B2 * 7/2013 Killingbeck ..... F04D 29/4293 285/360
8,529,222 B2 9/2013 Burns et al.
8,844,977 B2 * 9/2014 Sodergard ..... F04D 29/607 285/302
9,884,334 B2 * 2/2018 Uldry ..... B05B 11/3007
2002/0014771 A1 * 2/2002 Gotoh ..... F16L 13/103 285/371
2004/0034920 A1 * 2/2004 Antoniello ..... E03C 1/0408 4/570
2005/0012329 A1 * 1/2005 Brown ..... F16L 27/073 285/272
2006/0024174 A1 * 2/2006 Welch ..... F04D 1/063 417/360
2008/0085185 A1 * 4/2008 Towsley ..... F04D 1/063 415/198.1
2008/0121293 A1 * 5/2008 Leber ..... B05B 1/1636 137/597
2008/0277935 A1 * 11/2008 Killingbeck ..... F16L 37/252 285/403
2009/0214332 A1 * 8/2009 Towsley ..... F04D 1/063 415/199.4
2010/0263925 A1 * 10/2010 Spahic ..... H02G 3/065 174/665
2011/0123380 A1 5/2011 Thomas et al.
2011/0142599 A1 * 6/2011 Burgess ..... F04D 29/4286 415/127
2013/0082464 A1 * 4/2013 Sodergard ..... F04D 29/607 285/405
2013/0168309 A1 * 7/2013 Loniewski ..... E03C 1/0404 210/418
2015/0030470 A1 * 1/2015 Juarez Ortega ..... F04D 29/086 417/234
2015/0093266 A1 4/2015 Nelson et al.
2015/0211527 A1 7/2015 St. John et al.

* cited by examiner

NON-WELDED SUCTION CHAMBER FOR SURFACE PUMPING SYSTEMS

FIELD OF THE INVENTION

This invention relates generally to the field of surface pumping systems, and more particularly to a cost-effective suction chamber for use in multistage surface pumping systems.

BACKGROUND

Horizontal pumping systems are used in various industries for a number of different purposes. Horizontal pumping systems are often used in the oil and gas industry to move fluids between wells and surface facilities. Typically these horizontal pumping systems include a pump, a motor, and a suction chamber positioned between the pump and the motor. Often a thrust bearing chamber is also included between the motor and the suction chamber.

The suction chamber typically includes a cylindrical housing, a pair of end plates and an inlet branch. One of the end plates is configured to be attached to the thrust bearing and the opposite end plate is secured to the pump. The inlet branch connects the suction chamber to the source of fluid to be pumped by the horizontal pumping system. In many cases, the pumped fluid must be provided to the horizontal pumping system under significant pressure to supply the net positive suction head (NPSH) needed for proper operation of the pump. Accordingly, the suction chamber must be manufactured to operate under elevated fluid pressures.

In the past, the suction chamber has been manufactured by welding the end plates and inlet branch to the housing. To satisfy industry standards, the welding process must be meticulously performed and strenuously examined. The complexity of the welding process significantly increases the cost of the suction chamber. There is, therefore, a need for a more cost-effective suction chamber and an improved method of manufacturing a suction chamber. It is to these and other deficiencies in the prior art that the present invention is directed.

SUMMARY OF THE INVENTION

In an embodiment, the present invention includes a suction chamber for use in a surface pumping system. The suction chamber includes a central housing that is substantially cylindrical and has a motor end and a pump end opposite the motor end. The suction chamber includes a motor-end plate bolted to motor end of the central housing and a pump-end plate bolted to the pump end of the central housing. The suction chamber also includes an inlet branch connected to the central housing.

In another aspect, the embodiments include a surface pumping system that includes a suction chamber for use in a surface pumping system. The suction chamber includes a central housing that is substantially cylindrical and has a motor end and a pump end opposite the motor end. The suction chamber includes a motor-end plate bolted to motor end of the central housing and a pump-end plate bolted to the pump end of the central housing. The suction chamber also includes an inlet branch connected to the central housing.

In yet another aspect, the embodiments include a method for assembling a suction chamber. The method begins with the step of inserting an inlet branch through an inlet branch recess in a central housing. Next, the method continues with the step of locating the inlet branch against an inlet branch land in the central housing. Next, the method includes a step of installing a locking collar on the inlet branch from the inside of the central housing. The method concludes with the steps of securing a motor-end plate to the central housing; and securing a pump-end plate to the central housing.

DETAILED DESCRIPTION

Figure 1:
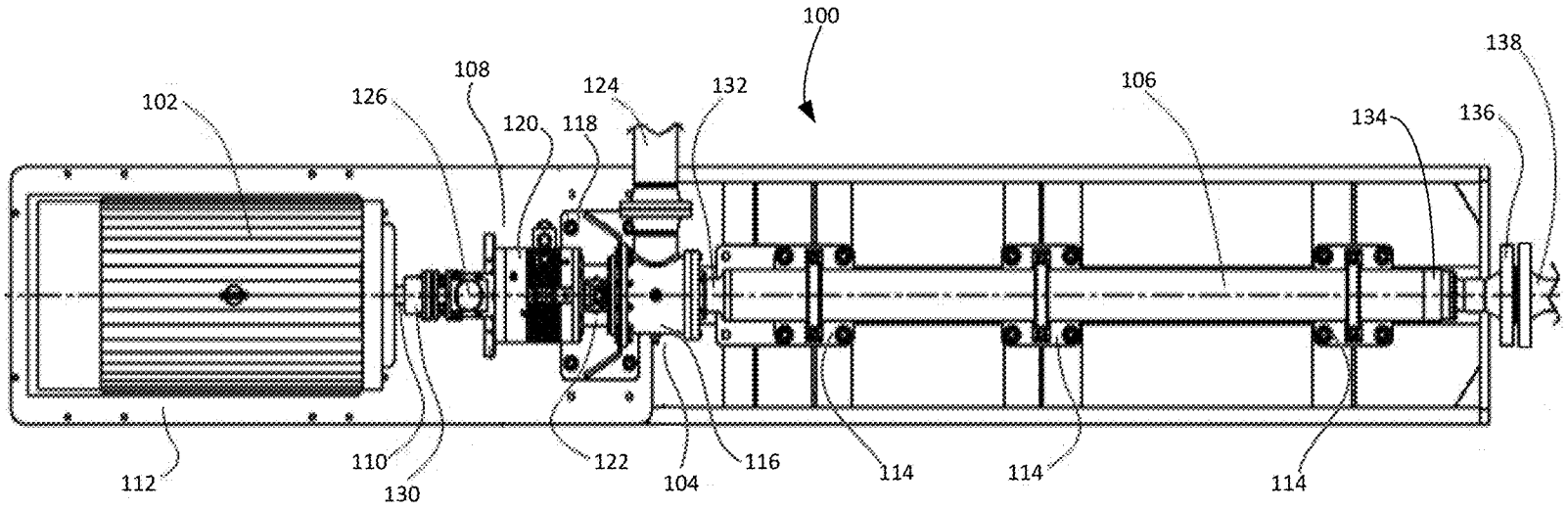
FIG. 1 is a top view of a surface pumping system constructed in accordance with an embodiment.
Figure 2:
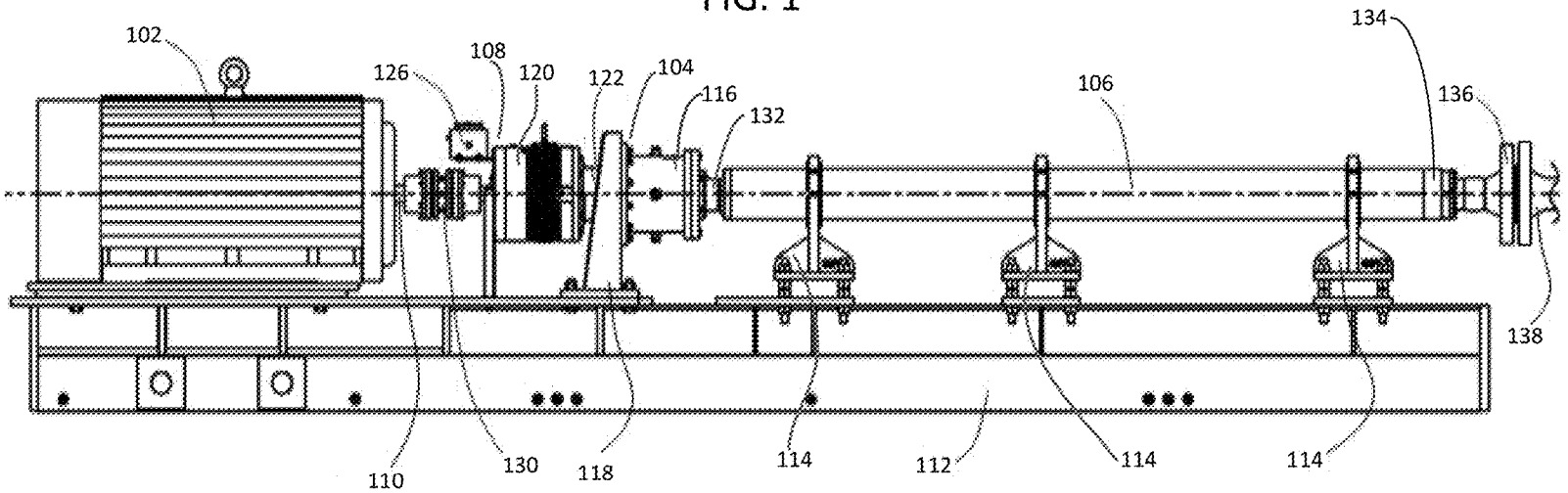
FIG. 2 is a side view of the surface pumping system of FIG. 1.

In accordance with an embodiment of the present invention, FIGS. 1 and 2 show top and side views, respectively, of a surface pumping system 100. The surface pumping system 100 includes a motor 102, a suction chamber assembly 104, a pump 106, a thrust bearing assembly 108, and a drive shaft 110. The motor 102 may be mounted to a platform 112. The pump 106 may be supported by one or more pump supports 114.

For the purposes of this disclosure, positional references may be made with respect to the motor 102 or pump 106 to refer to components within the pumping system 100 that are closer to the motor 102 or pump 106, respectively. Similarly, positional references may be made to upstream and downstream components based on their relative positions within the flow of fluid through the surface pumping system 100. For example, upstream components may refer to components closer to the suction chamber 104, while downstream components may refer to components more proximate to the pump 106. Although the form and function of the surface pumping system 100 is disclosed and shown in a horizontal configuration, it will be appreciated that the surface pumping system 100 might also be oriented in vertical and other non-vertical configurations.

The suction chamber assembly 104 includes a suction chamber 116, a bearing chamber adapter 122 mounted to the suction chamber 116, and a vertical bracket 118. The thrust bearing assembly 108 of the surface pumping system 100 includes a thrust bearing chamber 120 supported by the bearing chamber adapter 122. The suction chamber 116 is mounted to the vertical bracket 118 and has an inlet pipe 124. The surface pumping system 100 may also include a vibration sensor 126.

The drive shaft 110 may include a plurality of drive shaft segments connected together via one or more couplings 130 or by other means known in the art. It will be understood that the plurality of drive shaft segments and the one or more couplings 130 may be of different sizes and of any type known in the art. The drive shaft 110 extends from the motor 102, through the thrust bearing chamber 120, through the suction chamber 116 and into the pump 106. The pump 106 has an inlet end 132 and a discharge end 134. The inlet end 132 is connected to the suction chamber 116. A discharge head 136 may be connected to the discharge end 134 of the pump 106. A drop off element 138 may be connected to the discharge head 136. The drop off element 138 may be a rigid conduit, a flexible hose, a flexible coupling or any other type of suitable piping component known in the art. During operation, the inlet pipe 124 delivers fluid to the surface pumping system 100. The fluid may be water, liquid petroleum products, fluids separated from petroleum products, or any other fluid capable of being pumped. The fluid passes through the suction chamber 116 into the inlet end 132 of the pump 106, through the pump 106, out of the discharge end 134 of the pump 106 and into the drop off element 138.

Figure 3:
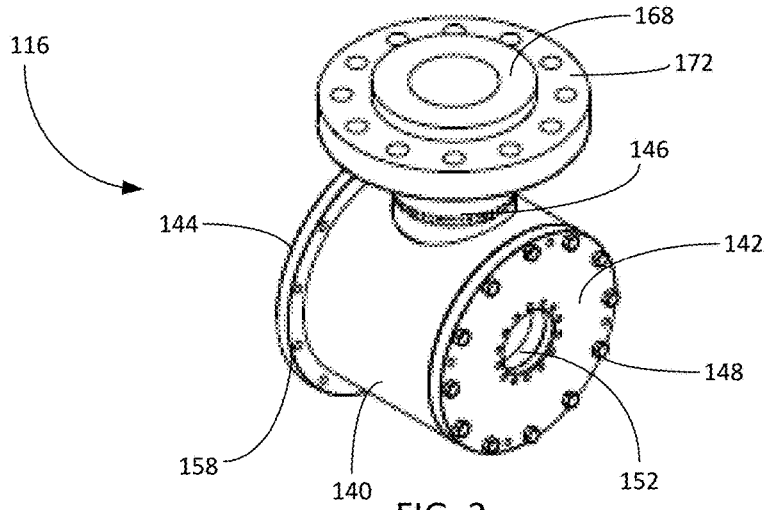
FIG. 3 is a perspective view of the suction chamber from the surface pumping system of FIG. 1.
Figure 4:
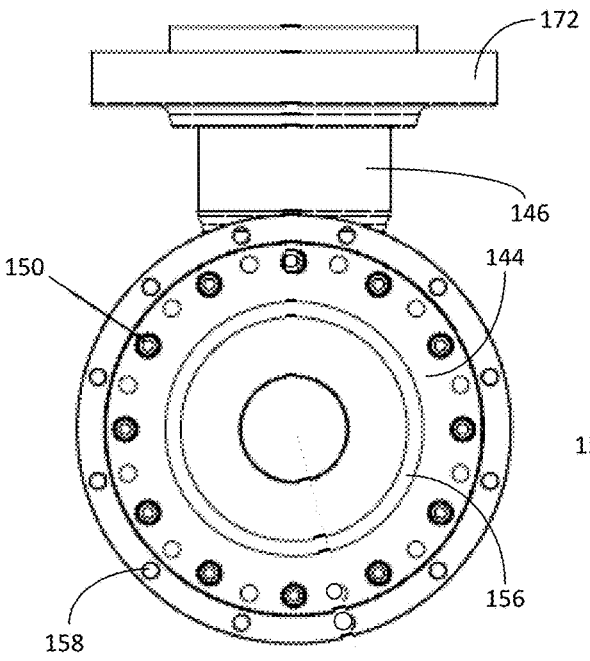
FIG. 4 is a view of the motor-end of the suction chamber of FIG. 3.
Figure 5:
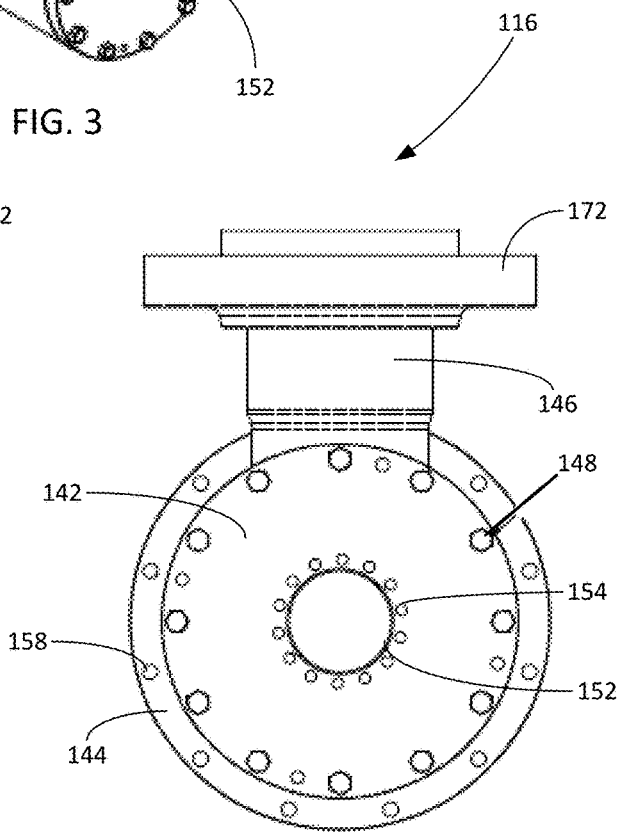
FIG. 5 is a view of the pump-end of the suction chamber of FIG. 3.

Turning to FIGS. 3-5, shown therein are perspective, motor-end and pump-end views, respectively, of the suction chamber assembly 116. The suction chamber 116 includes a central housing 140, a pump-end plate 142, a motor-end plate 144, and an inlet branch 146 that extends into the central housing 140. Unlike prior art suction chambers, the pump-end plate 142, motor-end plate 144 and inlet branch 146 are not welded to the central housing 140. Instead, these components of the suction chamber 116 are secured to the central housing 140 with fasteners and locking mechanisms, which obviates the need for expensive, time-consuming and technically difficult welding.

The pump-end plate 142 is secured to the central housing 140 with pump-end bolts 148. The motor-end plate 144 is secured to the central housing 140 with motor-end bolts 150. The pump-end plate 142 includes a central bore 152 and a series of inlet end holes 154 for connecting the pump-end plate 142 to the inlet end 132 of the pump 106. The drive shaft 110 and pumped fluid pass through the central bore 152 into the pump 106. The motor-end plate 144 includes a bearing package aperture 156 and a series of bearing chamber adapter holes 158 for connecting the motor-end plate 144 to the bearing chamber adapter 122. The larger bearing package aperture 156 is sized to admit a portion of the bearing package (not shown) from the bearing chamber adapter 122. When connected to the suction chamber 116, the bearings within the bearing chamber adapter 122 prevent fluid from passing from the suction chamber 116 into the thrust bearing chamber 120.

Figure 6:
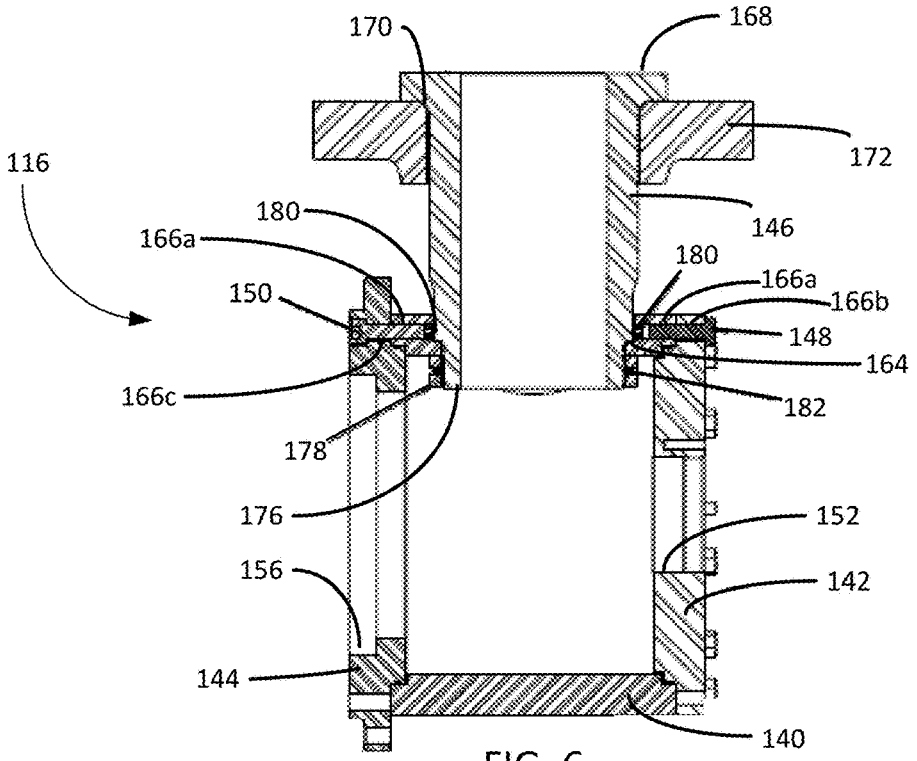
FIG. 6 is a cross-sectional view of the suction chamber of FIG. 3.
Figure 7:
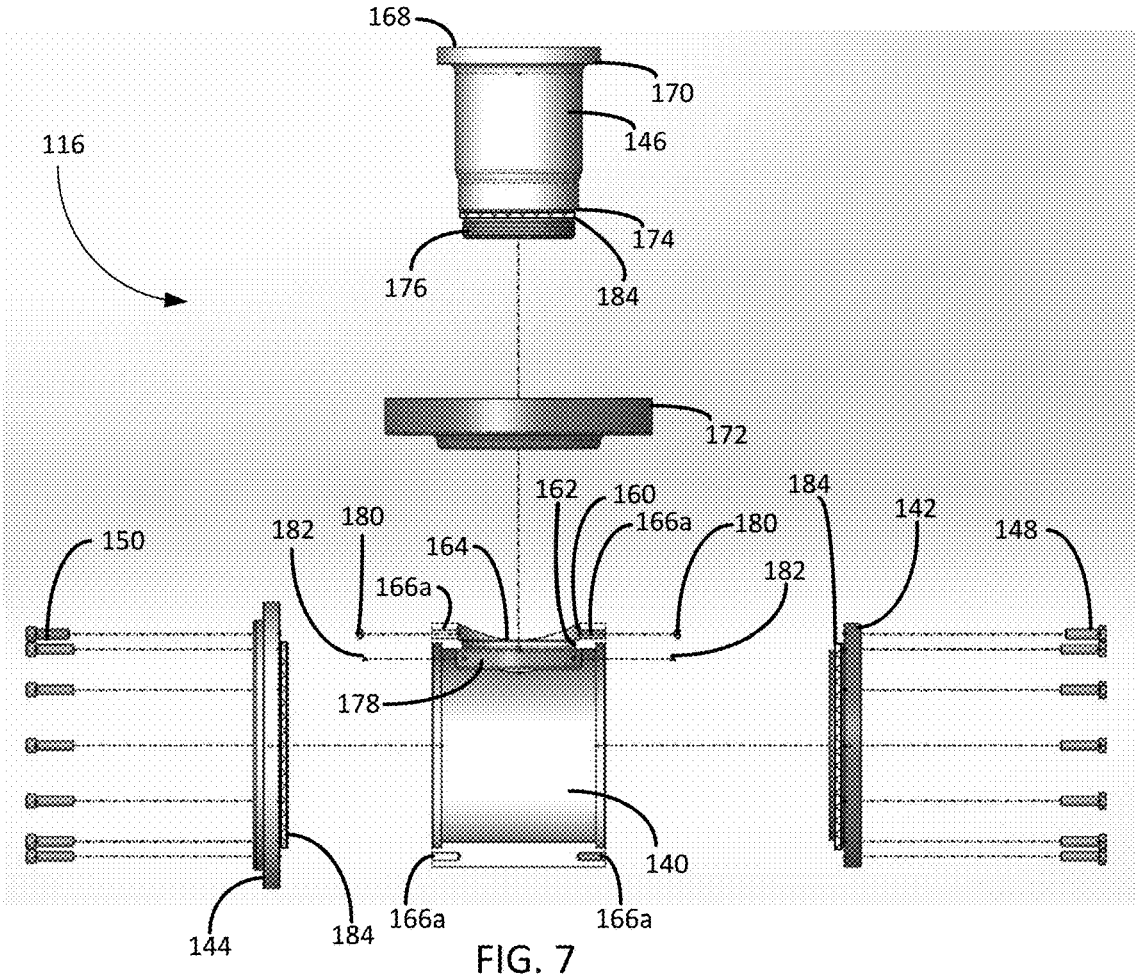
FIG. 7 is a partial exploded view of the suction chamber of FIG. 3.

Turning to FIGS. 6 and 7, shown therein are cross-sectional and partial exploded views, respectively, of the suction chamber 116. The central housing 140 has been partially removed in FIG. 7 to reveal additional components of the suction chamber 116. As illustrated in FIGS. 6 and 7, the central housing 140 includes an outer inlet branch recess 160 and an inner inlet branch recess 162 that are machined flat within the wall of the central housing 140. The outer inlet branch recess 160 is larger than the inner inlet branch recess 162 and the together they form an inlet branch land 164. As depicted in FIG. 6, bolt holes **166*a* extend into the central housing 140 from both the pump-end and motor-end and align with bolt holes 166*b* in the pump-end plate 142 and bolt holes 166*c* in the motor end plate 144. Certain bolt holes 166*a* that are proximate the inlet branch 146 intersect the inlet branch recess 160**.

The inlet branch 146 includes an exterior face 168, an upper shoulder 170 and a connection flange 172 that is sized to press against the upper shoulder 170 of the inlet branch 146. The connection flange 172 is configured to be attached to a mating flange on the inlet pipe 124 to secure the exterior face 168 against the inlet pipe 124 (shown in FIG. 1). In some embodiments, the connection flange 172 is a lap joint flange or a weld neck flange.

The inlet branch 146 further includes a lower shoulder 174, a threaded end 176 and a locking collar 178. The inlet branch 146 is sized to fit in close tolerance with the outer inlet branch recess 160 and inner inlet branch recess 162. The lower shoulder 174 of the inlet branch 146 is configured to abut the inlet branch land 164 within the central housing 140. The locking collar 178 is configured to be threaded onto the threaded end 176 of the inlet branch 146 inside the central housing 140. In this way, the inlet branch 146 can be inserted into the central housing 140 through the outer inlet branch recess 160 to allow the threaded end 176 to pass through the inner inlet branch recess 162. The insertion of the inlet branch 146 within the central housing 140 is stopped when the lower shoulder 174 contacts the inlet branch land 164. The locking collar 178 and threaded end 176 draw the inlet branch 146 into a press fit against the inlet branch land 164.

To prevent the inlet branch 146 from movement relative the central housing 140, the suction chamber 116 includes outer set screws 180 that lock the inlet branch 146 and central housing 140 together. In some embodiments, the outer set screws 180 are inserted through the exterior bolt holes **166*b* and 166*c*, through interior bolt holes and into position against the inlet branch 146. It will be appreciated that one or more set screws 180 may be used to lock the inlet branch 146 into position within the central housing 140. To prevent the locking collar 178 from rotating with respect to the threaded end 176, the inlet branch 146 is provided with inner set screws 182 that extend through the locking collar 178 to engage the threaded end 176**.

To prevent leakage of fluid out of the suction chamber 116, the suction chamber 116 may be fitted with one or more seals 184. In some embodiments, o-ring seals 184 are positioned between the pump-end plate 142 and the central housing 140, between the motor-end plate 144 and the central housing 140 and between the inlet branch 146 and the central housing 140.

Figure 8:
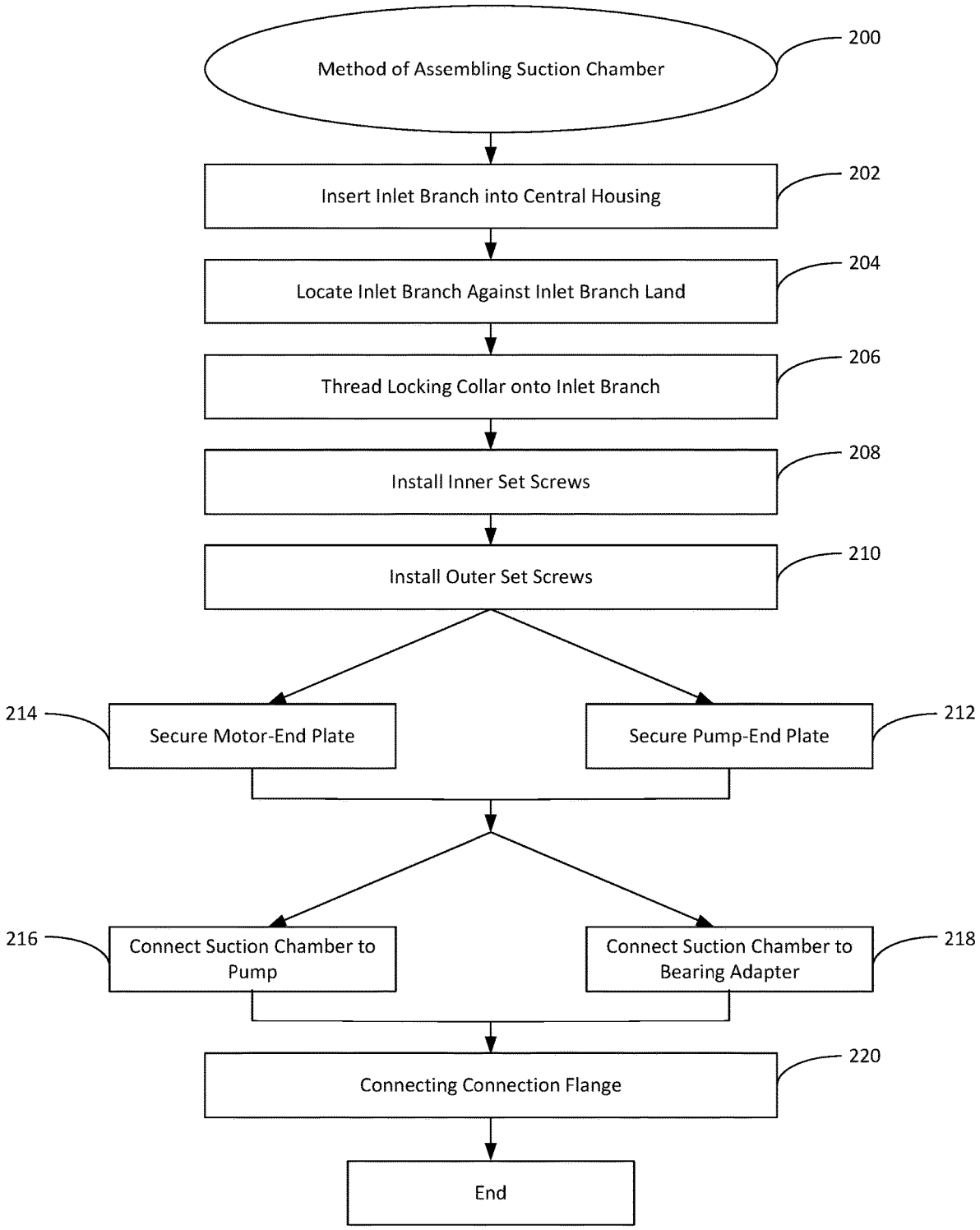
FIG. 8 is a process flow diagram illustrating a method of assembling the suction chamber of FIG. 3.

Turning to FIG. 8, shown therein is a process flow diagram illustrating a method 200 for assembling the suction chamber 116. The method of assembly 200 begins at step 202 by inserting the inlet branch 146 into the central housing 140 through the outer inlet branch recess 160. At step 204, the inlet branch 146 is placed against the inlet branch land 164. Next, at step 206, the locking collar 178 is threaded onto the threaded end 176 of the inlet branch 146 and torqued to the desired extent. At step 208, the inner set screws 182 are installed through the locking collar 178. Next, at step 210, the outer set screws 180 are installed through bolt holes 166 to lock the inlet branch 146 into the central housing 140.

The method 200 continues at steps 212 and 214 by securing the pump-end plate 142 and motor-end plate 144 onto the central housing 140. As indicated in FIG. 8, step 212 may be performed before, during or after step 214. The method 200 continues at steps 216 and 218 by connecting the suction chamber 116 to the pump 106 and to the bearing chamber adapter 122. Step 216 may be performed before, during or after step 218. Next, at step 220, the connection flange 170 is connected to a mating flange on the inlet pipe 124. In an alternate embodiment, step 220 takes place before steps 216 and 218. In yet another alternate embodiment, step 220 takes place before steps 212 and 214

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. A suction chamber useable in a surface pumping system having a pump driven by a motor, the suction chamber comprising:

a substantially cylindrical central housing, wherein the central housing has a motor end, a pump end opposite the motor end, and an interior between the motor end and the pump end, and an inlet branch land on the central housing between the pump and the motor end;

a removable motor-end plate bolted to the motor end of the central housing and connected to a bearing chamber adapter;

a removable pump-end plate bolted to the pump end of the central housing and connected to an inlet end of the pump, wherein the removable motor-end plate and the removable pump-end plate define the interior between the motor end and the pump end of the central housing; and an inlet branch connected to the central housing, wherein the inlet branch comprises:

a lower shoulder in contact with the inlet branch land;

a threaded end that extends into the interior of the central housing; and a locking collar threaded onto the threaded end, wherein the locking collar is in the interior of the central housing.

2. The suction chamber of claim 1, wherein the inlet branch land comprises:

an outer inlet branch recess extending into the central housing from the exterior of the central housing; and an inner inlet branch recess extending into the central housing from the interior of the central housing.

3. The suction chamber of claim 2, wherein the inlet branch further comprises:

an upper shoulder; and a connection flange adjacent the upper shoulder.

4. The suction chamber of claim 2, wherein the locking collar further comprises at least one inner set screw.

5. The suction chamber of claim 2, wherein the central housing further comprises at least one outer set screw in contact with the inlet branch.

6. The suction chamber of claim 2, further comprising:

a first o-ring seal between the motor-end plate and the central housing;

a second o-ring seal between the pump-end plate and the central housing; and a third o-ring seal between the inlet branch and the central housing.

7. A surface pumping system comprising:

a motor;

a thrust bearing assembly connected to the motor, wherein the thrust bearing assembly includes a bearing chamber adapter;

a pump driven by the motor; and a suction chamber connected between the pump and the thrust bearing assembly, wherein the suction chamber comprises:

a substantially cylindrical central housing that defines an interior of the central housing and an inlet branch land;

a removable motor-end plate bolted to the central housing, wherein the bearing chamber adapter is bolted to the motor-end plate;

a removable pump-end plate bolted to the central housing, wherein the pump is bolted to the pump-end plate;

wherein the removable motor-end plate and the removable pump-end plate define the interior between the motor end and the pump end of the central housing; and an inlet branch connected to the central housing, wherein the inlet branch comprises:

a lower shoulder in contact with the inlet branch land;

a threaded end that extends into the interior of the central housing; and a locking collar threaded onto the threaded end, wherein the locking collar is in the interior of the central housing.

8. The surface pumping system of claim 7, wherein the inlet branch land comprises:

an outer inlet branch recess; and an inner inlet branch recess.

9. The surface pumping system of claim 8, wherein the inlet branch further comprises:

an upper shoulder; and a connection flange adjacent the upper shoulder.

10. The surface pumping system of claim 8, wherein the locking collar further comprises at least one inner set screw.

11. The surface pumping system of claim 8, wherein the central housing further comprises at least one outer set screw in contact with the inlet branch.

12. The surface pumping system of claim 8, further comprising:

a first o-ring seal between the motor-end plate and the central housing;

a second o-ring seal between the pump-end plate and the central housing; and a third o-ring seal between the inlet branch and the central housing.

13. A method of assembling a suction chamber for use in a surface pumping system, the method comprising the steps of:

inserting an inlet branch through an inlet branch recess in a central housing;

locating a lower shoulder of the inlet branch against an inlet branch land in the central housing;

installing a locking collar on the inlet branch from the inside of the central housing;

securing a removable motor-end plate to the central housing, wherein the removable motor end plate is connected to a bearing chamber adapter; and securing a removable pump-end plate to the central housing, wherein the removable pump end plate is connected to an inlet end of a pump.

14. The method of claim 13, wherein the step of installing a locking collar further comprises threading the locking collar onto a threaded end of the inlet branch.

15. The method of claim 14, wherein the step of installing the locking collar further comprises the step of installing set screws to prevent the disengagement of the locking collar from the threaded end of the inlet branch.

16. The method of claim 13, further comprising a step of installing set screws through the central housing to prevent the rotation of the inlet branch.

17. The method of claim 13, wherein the step of securing the motor-end plate to the central housing further comprises bolting the motor-end plate to the central housing with motor-end bolts.

18. The method of claim 13, wherein the step of securing the pump-end plate to the central housing further comprises bolting the pump-end plate to the central housing with pump-end bolts.

* * * * *